US005738532A

United States Patent [19]

Takano et al.

[11] Patent Number: 5,738,532

[45] Date of Patent: Apr. 14, 1998

[54] CONNECTOR PIN CONTACT

[75] Inventors: Yasunari Takano; Hidehiro Nakamura; Shin Yoshida; Akito Miura; Koichi Takahashi; Kazuki Satou, all of Miyagi-ken, Japan

[73] Assignee: Alps Electric Co., Ltd., Tokyo, Japan

[21] Appl. No.: 602,201

[22] Filed: Feb. 16, 1996

[30] Foreign Application Priority Data

Mar. 8, 1995 [JP] Japan ..... 7-048811
Sep. 6, 1995 [JP] Japan ..... 7-229326

[51] Int. Cl.[6] ..... H01R 9/09

[52] U.S. Cl. ..... 439/79; 439/64

[58] Field of Search ..... 439/943, 733.1, 439/444, 869, 79, 80

[56] References Cited

U.S. PATENT DOCUMENTS 4,717,354 1/1988 McCleerey ..... 439/444
4,857,001 8/1989 Nakano et al. ..... 439/733.1
4,992,052 2/1991 Verhoeven ..... 439/79
5,139,446 8/1992 Costello et al. ..... 439/943
5,263,882 11/1993 Peterson ..... 439/869
5,286,218 2/1994 Sakurai et al. ..... 439/733.1

FOREIGN PATENT DOCUMENTS 7-272803 10/1995 Japan .

*Primary Examiner*—Neil Abrams
*Assistant Examiner*—Barry Matthew L. Standig
*Attorney, Agent, or Firm*—Guy W. Shoup; Patrick T. Bever

[57] ABSTRACT

A pin contact of a connector and a method of fabricating the pin contact which enables a substantial decrease of manufacturing cost, and smooth installation of the pin connector without a change in the pitch of arrangement at the time of press-fitting into a pin housing. A flat metal sheet undergoes blanking and pressing to form a narrow piece including a strip portion of decreased area of a fracture. Then an approximately L-shaped connecting portion is bent at right angles to raise the narrow piece sideways. Thereafter the strip portion of the narrow piece is pressed along the direction of rising, to thereby form an approximately cylindrical contact section. A raised piece at the rear of the contact section is provided with a locking section which faces approximately at right angles with the direction of arrangement.

2 Claims, 11 Drawing Sheets

11
16
15
14
6B
13
13a
17
18

CONNECTOR PIN CONTACT

BACKGROUND OF THE INVENTION

1. Field of the Invention

The present invention relates to a pin contact to be mounted to such a connector as a PC card connector, and a method for fabricating the pin contact.

2. Description of the Related Art

A PC card to be used in a notebook type personal computer is a memory card which, when used, is inserted in a PC card connector. With recent promotion of industrial standardization of the shape of this PC card and the dimensions and arrangements of a pin contact of the PC card connector, a rapid increase in demand for the card as well as a rapid progress of applications of the products are expected.

Generally the PC card connector is made up roughly of a pin header section with a multitude of pin contacts pressed in and secured in a specific arrangement in a pin housing, a frame for guiding the PC card at the time of insertion and removal, and an ejection mechanism section attached on this frame for ejecting the PC card. Each of the pin contacts is provided at one end with an approximately cylindrical contact section to be inserted into and removed from a socket contact in the PC card, and at the other end with a terminal section to be soldered to a printed board. The contact section has been standardized to be 0.44 mm in diameter (0.46 mm or less in width); particularly in the case of a face-mounted PC card connector, it is desirable that the terminal section be formed of an about 0.3 mm thick band-like sheet with a soldering strength taken into consideration.

FIG. 23 is a perspective view showing a conventional pin contact stated above. In this drawing, a reference numeral 30 refers to a pin contact comprising a 0.44 mm-diameter contact section 31 at one end and an about 0.3 mm thick band-like terminal section 32 at the other end. The base of the terminal section 32 continues to a comparatively thick portion 33 measuring 0.45 mm in sheet thickness, the thick portion 33 continuing to the contact section 31. On the end side surface of the thick portion 33 is provided with an engaging section **33*a* for engaging the pin contact with an inner wall surface of a pin insertion hole of a pin housing not illustrated. A wall surface located behind the contact section 31 of the thick section 33 serves as a receiving surface 33*b*** which abuts with a jig when pressing the pin contact into the pin housing.

According to a conventional method for producing the pin contact 30 of the above-described shape, a sheet of irregular shape 34 having various thicknesses as shown in FIG. 24 is used; the terminal section 32 is formed by pressing the end portion subsequently to punching the thick portion (sheet thickness t1=0.45 mm) of the sheet of irregular shape 34, to form the thick portion 33 and the contact section 31, and then by punching the thin portion (sheet thickness t2=0.3 mm) of the same sheet 34.

The above-described sheet of irregular shape 34, however, is a very expensive material as compared with an ordinary flat sheet, and therefore the conventional pin contact 30 is disadvantageous because of a high material cost and accordingly a high manufacturing cost. In the PC card connector, the arrangement pitch of a multitude of pin contacts to be pressed in the pin insertion holes of the pin housing is specified as narrow as 1.27 mm. In the case of the above-described conventional pin contact 30, since the locking section **33*a* which engages with the inner wall surface of the pin insertion hole when pressed in is nearly in a specific direction of arrangement, pin housing deformation caused by the press fitting of each of the pin contacts 30 is accumulated to thereby result in an improper pitch of arrangement. Furthermore, the pin contact 30 thus arranged at such a narrow pitch is restricted in a dimension (width) along the direction of arrangement, which must be made as small as possible, thus resulting in too narrow a receiving surface 33*b* for abutting with the mounting jig and accordingly in unsmooth insertion of the pin contact 30**.

SUMMARY OF THE INVENTION

In view of the above-described various disadvantages inherent in the heretofore known techniques, it is a first object of the present invention to provide a pin contact of a connector which allows a substantial decrease in manufacturing cost and smooth installation into a pin housing without affecting the pitch of arrangement. It is a second object of the present invention to provide a method of fabricating the above-described pin contact.

To accomplish the first object, the pin contact of the present invention has at one end an approximately cylindrical contact section and at the other end a band-like terminal section, and is of such a constitution that a rear sheet portion of the contact section is raised nearly at right angles with the base of the terminal section, thus making a raised piece of the same thickness as the terminal section, a locking section is provided on the surface of the raised piece nearly perpendicular to the direction of rising, for locking on the inner surface of a pin insertion hole of a pin housing, and that a jig receiving section is provided, on the rear end face of the raised piece, for abutting with a jig when mounting the pin contact into the pin housing. At this time, a convexly curved surface is preferably provided on the rear end face of the raised piece with the extension of the axis of the contact section intersecting with the top section of the convexly curved surface, so that the top section of this curved surface will serve as the aforementioned jig receiving section.

To accomplish the second object described above, according to the fabricating method of the present invention, the approximately cylindrical contact section is formed by punching a flat metal sheet to form a narrow piece extending straight from an approximately L-shaped connecting part, then bending the connecting part nearly at right angles to raise the narrow piece sideways, and finally pressing at least the forward end portion of the narrow piece along the direction of rising. In this case, prior to raising the narrow piece sideways, it is preferable to press a part of fracture of the narrow piece, which will become the contact section, to thereby reduce the area thereof.

Pressing at least the forward end portion of the narrow piece raised sideways along the direction of rising can form the approximately cylindrical 0.44 mm-diameter contact section from for example an about 0.3 mm thick sheet. Thus it is possible to fabricate a pin contact from a comparatively inexpensive, flat metal sheet in place of an expensive sheet of irregular shape. In advance to bending to raise the narrow piece sideways, a portion of the fracture formed at the time of punching, which will become the contact section is pressed to reduce the area, thereby facilitating to press, after bending to raise the narrow piece, the surface of the contact section to a smooth curved surface, which will scarcely be affected by the roughness of the fracture.

In the pin contact thus fabricated the sheet portion behind the contact section of the raised narrow piece serves as the raised piece. A locking section which produces a locking force when the pin contact is pressed into the pin housing is provided nearly rectangularly to the direction of rising on the surface of this raised piece; the locking section will not face to the direction of arrangement of the pin contact, and therefore there will occur no accumulation of deformation of the pin housing likely to be caused by the press-fitting of the pin contact.

Furthermore, the provision of a jig receiving section on the rear end surface of the raised piece makes it possible to abut a portion little restricted by dimensions, off the direction of arrangement of the pin contact, against the mounting jig. Therefore, a relatively wide receiving surface is obtainable for pin contacts to be arranged at a narrow pitch. Furthermore, by using the top section of the convexly curved surface provided at the rear end surface of the raised piece as the jig receiving section, the top section intersecting the extension of the axial center of the contact section can be abutted properly with the mounting jig. It is, therefore, possible to push in the contact section from right behind at the time of press-fitting. Therefore since no excessive pressure is applied to the pin contact, there will never occur such a trouble as deformation of the terminal section.

These and other features, objects and advantages of the present invention will become more obvious from the following description when taken in connection with the accompanying drawings.

DESCRIPTION OF THE PREFERRED EMBODIMENTS

Figure 1:
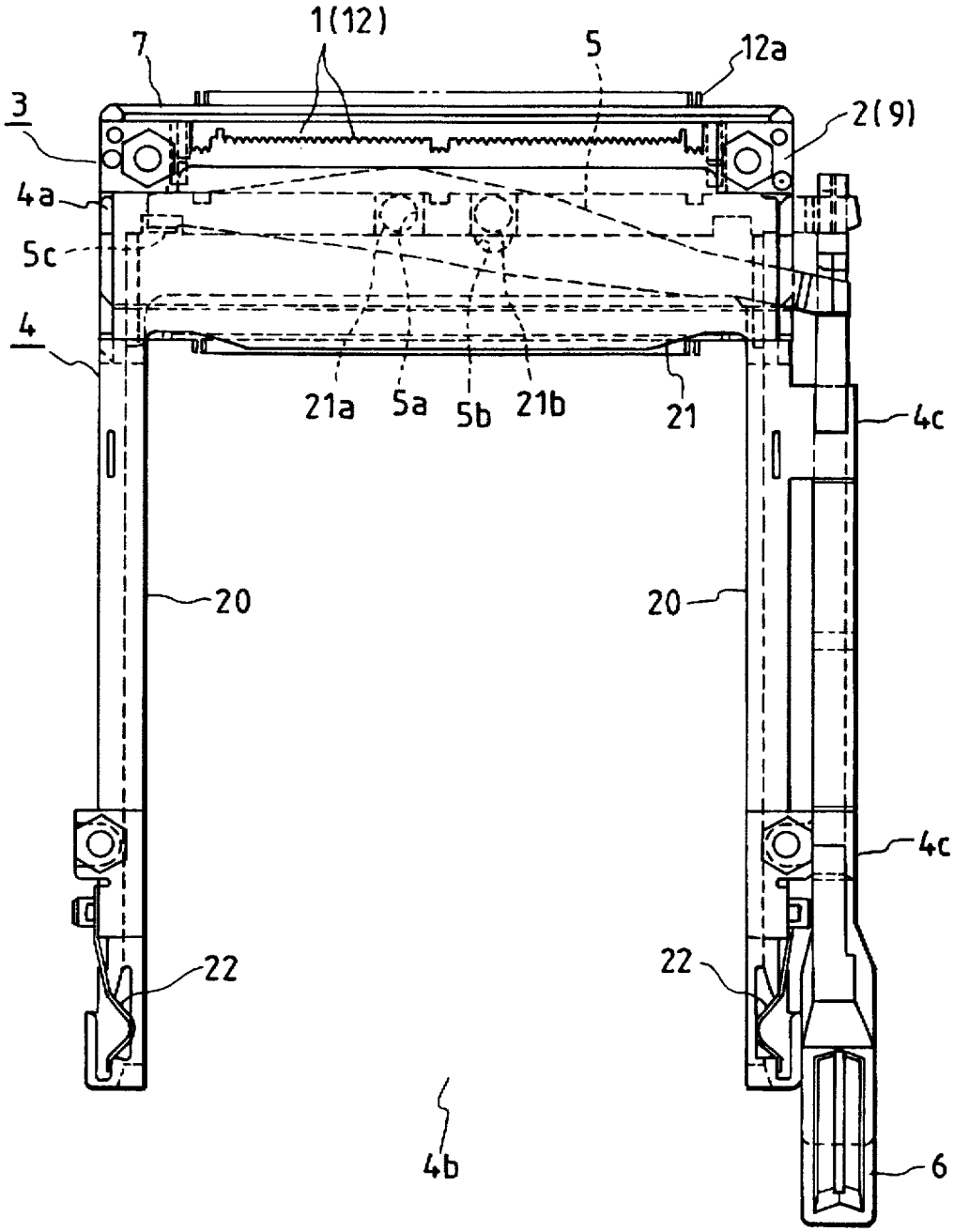
FIG. 1 is a general plan view showing one embodiment of a face-mounted PC card connector according to the present invention.

Hereinafter a preferred embodiment of a PC card connector according to the present invention will be explained with reference to the accompanying drawings.

The connector shown in FIG. 1 to 4 mainly comprises a header section 3 securely pressed in a pin housing 2 with a multitude of pin contacts 1 in specific configuration, two approximately U-shaped frames 4 for guiding a PC card which is not illustrated, at the time of insertion and removal, and an eject lever 5 and a push rod 6 as ejecting members of an ejecting mechanism section attached to each frame 4.

Figure 5:
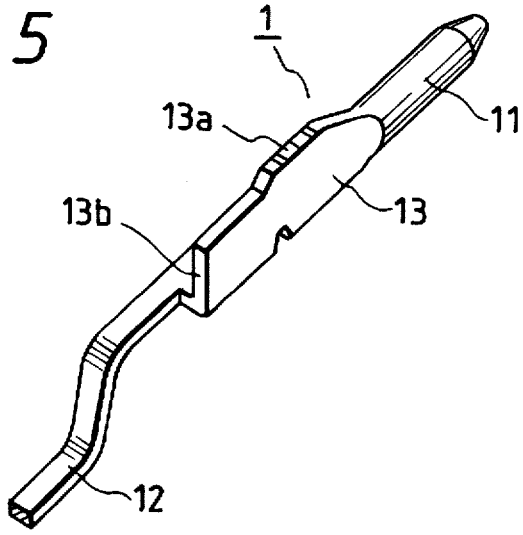
FIG. 5 is a perspective view showing a major portion of the pin contact to be used in the connector.

The shape of the pin contact 1, as shown in FIG. 5, has an about cylindrical contact section 11 at one end and a band-like terminal section 12 at the other end. The rear sheet-like portion of the contact section 11 is raised squarely in relation to the base of the terminal section 12 to form a raised piece 13 of the same thickness as the terminal section 12. A locking section 13*a* for locking the pin contact section 11 on the inner wall surface of a pin insertion hole 2*a* of the pin housing 2 is provided on the surface of the raised piece 13 which is nearly at right angles with the rising direction. The rear end face of the raised piece 13 serves as a jig receiving section 13*b* which abuts with a jig (not illustrated) when the pin is pressed into the pin housing 2. Concretely, the contact section 11 has been pressed in a tapered form at the end portion and in a cylindrical form measuring 0.44 mm in diameter in the other portion. The terminal section 12 and the raised piece 13 are produced of a 0.3 mm thick sheet, the former being formed in a specific configuration.

Figures 6A, 6B:
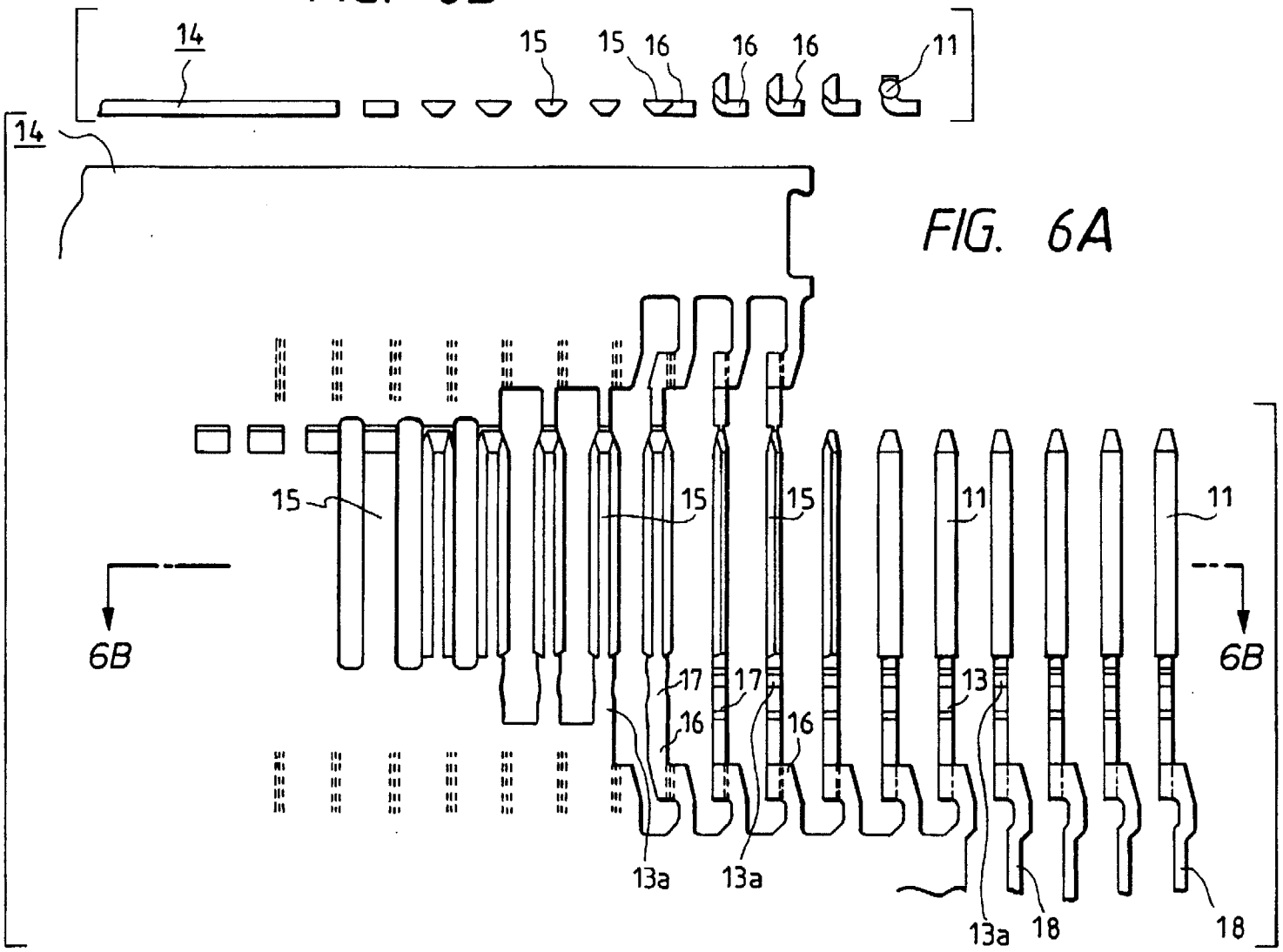
FIGS. 6A and 6B show top and section side views of a fabrication process chart of the pin contact shown in FIG. 5.

The pin contact 1 described above, as shown in the fabrication process chart in FIGS. 6A and 6B, has been produced in the following procedure. In FIG. 6A and 6B are shown changes in the planar form of the pin contact 11 under fabrication and FIG. 6B shows these changes in the sectional form along the line 6B—6B. The process proceeds from left to right in the drawing.

To fabricate the pin contact 1, a 0.3 mm thick hoop-like metal sheet 14 on a carrier tape not illustrated is prepared first. The metal sheet 14 is first subjected to blanking and pressing to produce a strip portion 15 which will become the contact section 11. The pressing work is done to incline the end portion and fracture surface. Subsequently the blanking is done to form a narrow piece 17 (including the strip portion 15) extending straight from an approximately L-shaped connecting part 16, and then the connecting portion 16 is bent squarely to raise the narrow piece 17 sideways. However, on the fracture surface at the rear of the strip portion 15 of the narrow piece 17 is formed the locking section 13*a* before raising. Thereafter the forward end of the raised narrow piece 17 is cut off from the body material, and the strip portion 15 is pressed vertically along the direction of rising, thereby forming the contact section 11 in the tapered form at the end portion and in the approximately cylindrical form at the other portion set at 0.44 mm in diameter. Then, the body material shown at the bottom of the drawing which supports the connecting portion 16 is pressed to form a long band-like portion 18 consisting of the terminal section 12. Thereafter a specific number of band-like portions 18 are cut off from the hoop-like metal sheet 14, then the band-like portion 18 is formed into the terminal section 12. The pitch between adjacent terminal sections 12 is set at 1.27 mm.

After thus obtaining a predetermined number of pin contacts 1 held by the carrier tape, each of the pin contacts 1 is inserted into the pin insertion hole 2*a* of the pin housing 2 from the contact section 11 side; the carrier tape is disconnected; the amount of projection of the terminal section 12 is adjusted while engaging the locking section 13*a* with the inner wall surface of the pin insertion hole 2*a*; and finally, the terminal sections 12 are cut so that their ends will be at the same level, thus completing the mounting of each pin contact 1 to the pin housing 2.

In the embodiment described above, since it is possible to form the approximately cylindrical, 0.44 mm-diameter contact section 11 from a 0.3 mm thick sheet by pressing, along the direction of rising, the strip portion 15 of the narrow piece 17 which has been raised sideways, the pin contact 1 can be fabricated by the use of the relatively cheap metal sheet 14 instead of an expensive sheet of irregular shape which varies in sheet thickness. Prior to raising the narrow piece 17 sideways, the portion (strip portion 15) of the fracture of the narrow piece 17 formed by the blanking work, which will become the contact section 11 is pressed to decrease its surface area. Therefore it is possible to easily finish the surface of the contact section 11 to a smooth curved surface by pressing work after raising, almost without an effect of the coarseness of the rupture. This method, therefore, is suitable for the fabrication of highly reliable pin contacts 1.

In the pin contact 1 thus fabricated, the sheet portion behind the contact section 11 of the narrow piece 17 after raising becomes the raised piece 13. The locking section 13*a* for locking to the inner wall surface of the pin insertion hole 2*a* of the pin housing 2, being formed on the surface of the raised piece 13 nearly square to the direction of rising, is off the direction of arrangement of the pin contact 1, thereby preventing accumulation of deformation of the pin housing 2 caused by the insertion of each pin contact 1. Therefore, there is no fear that the pitch of arrangement of the pin contact 1 pressed in and secured will largely vary. In this pin contact 1, the jig receiving section 13*b* is provided, at the rear end surface of the raised piece 13, for abutting with the jig at the time of insertion into the pin housing 2. This jig receiving section 13*b* can expand squarely with respect to the direction of arrangement of the pin contact 1, that is, in a direction in which it will be little restricted by dimensions. Therefore, even such a pin contact 1 that will be arranged at as narrow a pitch as 1.27 mm has a relatively wide receiving surface which serves as the jig receiving section 12*b*, which therefore allows smooth installation of the pin contact 1.

Next, components of the pin header section 3 except the pin contact 1 will be explained in detail.

The pin header section 3 is roughly composed of the pin housing in which a specific number of pin contacts 1 are pressed in and secured, and two pin holders 7 and 8 mounted at the front and rear of the pin housing 2. The pin housing 2 is further divided into two body sections 9 of the same shape vertically placed and secured in two stages with the pin contact 1 pressed in and secured, and a base section 10 secured beneath these body section and then directly mounted on the face of the printed board. One pin holder 7 disposed behind the pin housing 2 positions the terminal section 12 of the pin contact 1 protruding downwards from behind the body section 9 at the upper stage, while the other pin holder 8 disposed at the front of the pin housing 2 positions the terminal section 12 of the pin contact 1 which is sent forwards from behind the body section 9 at the lower stage and protrudes downwards.

Figure 7:
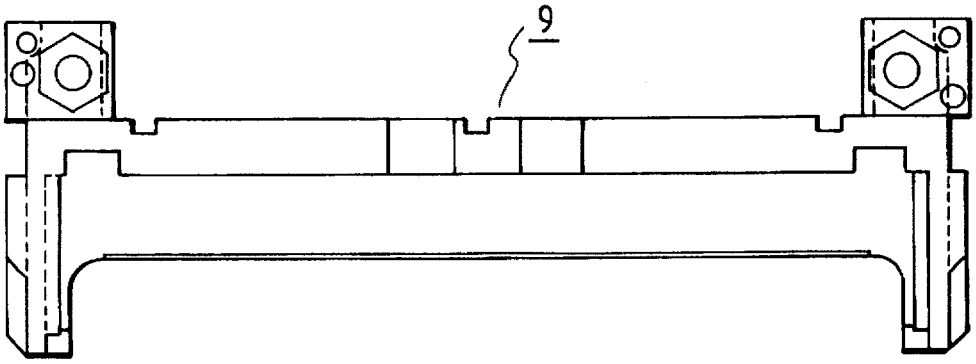
FIG. 7 is a plan view of a body section constituting the pin housing of the connector.
Figure 8:
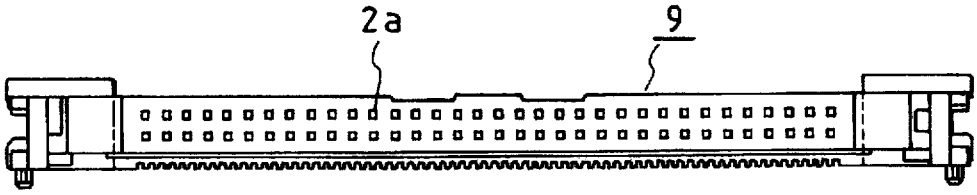
FIG. 8 is a front view of the body section shown in FIG. 7.
Figure 9:
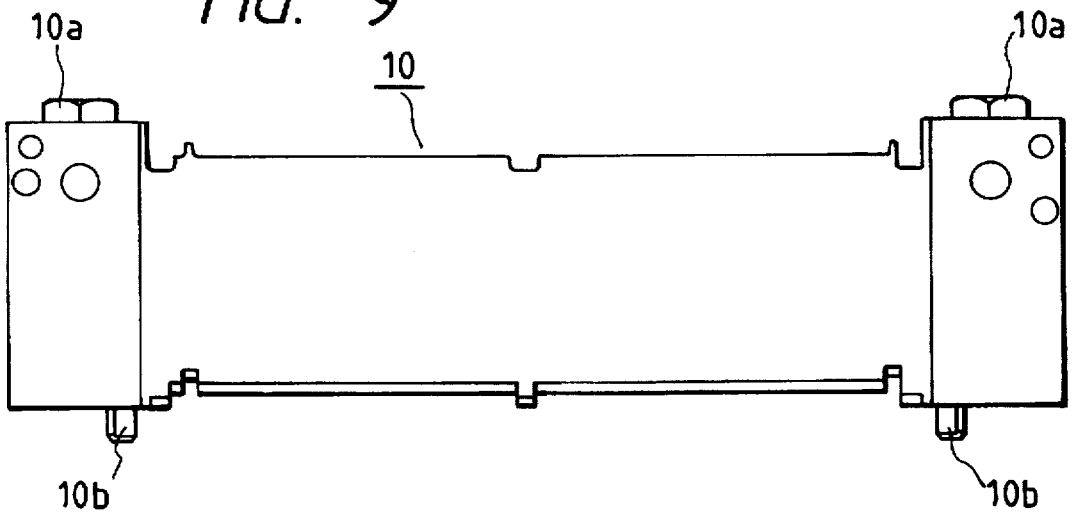
FIG. 9 is a plan view of a base section constituting the pin housing of the connector.
Figure 10:
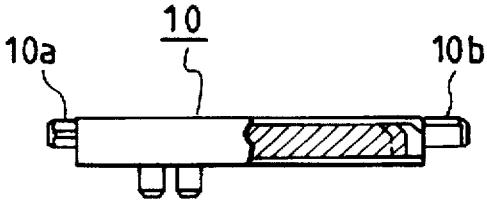
FIG. 10 is a partly sectioned side view of the base section shown in FIG. 9.
Figure 11:
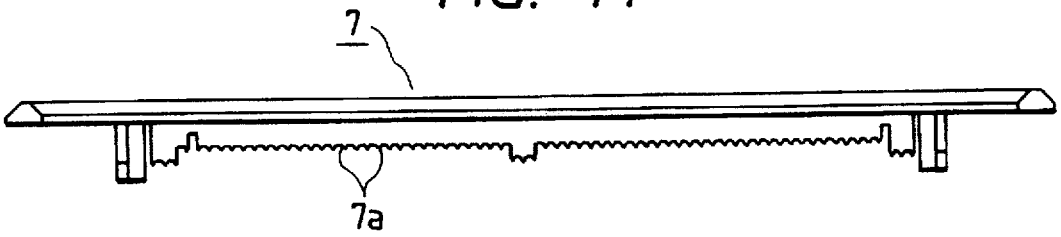
FIG. 11 is a plan view of a pin holder attached at the rear of the pin housing of the connector.
Figure 12:
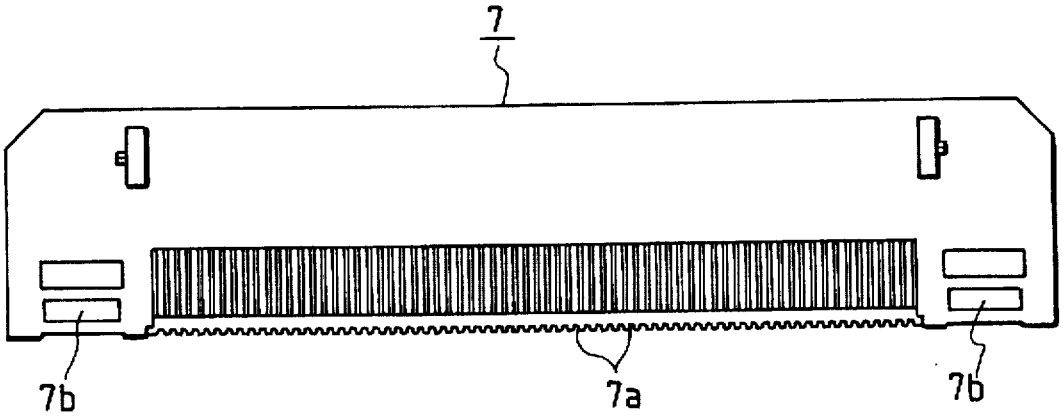
FIG. 12 is a front view of the pin holder shown in FIG. 11.
Figure 13:
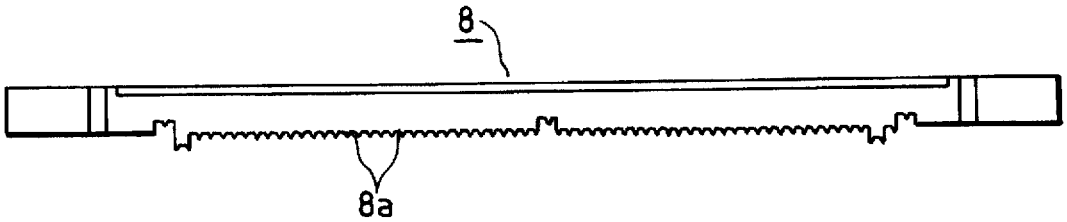
FIG. 13 is a plan view of a pin holder attached at the front of the pin housing of the connector.
Figure 14:
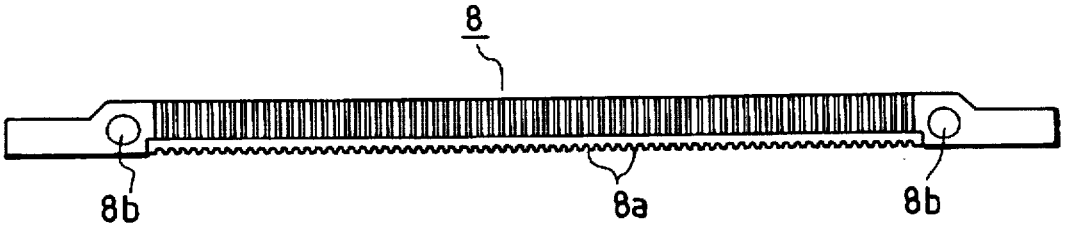
FIG. 14 is a rear view of the pin holder shown in FIG. 13.
Figure 15:
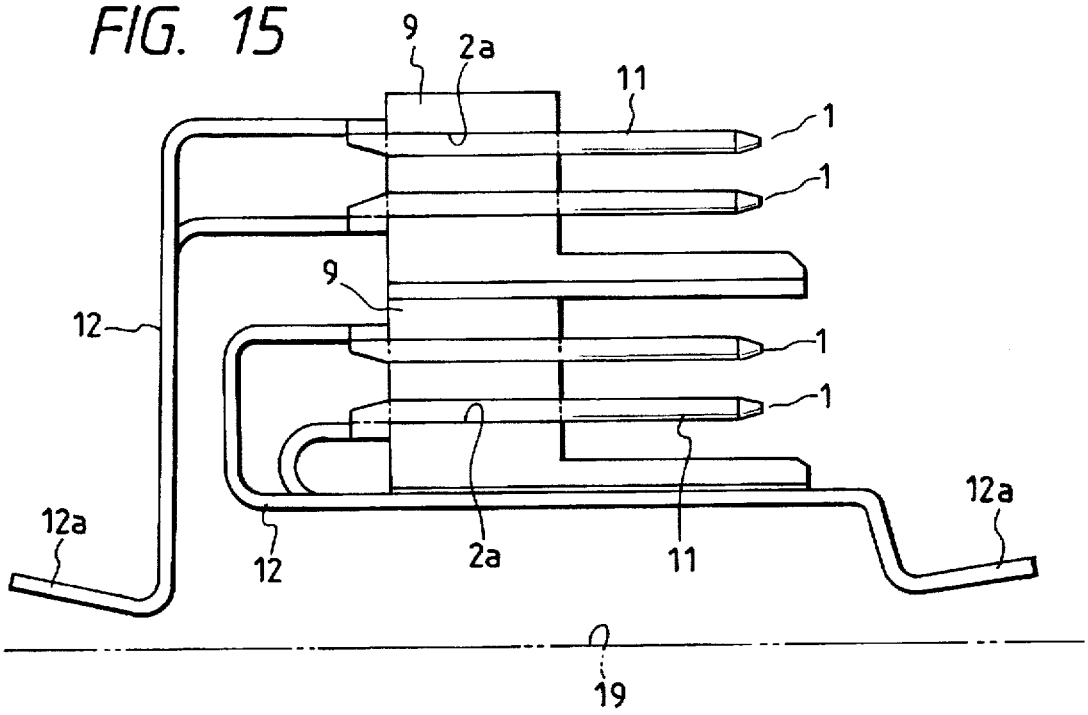
FIG. 15 is an explanatory view showing the shape of a pin contact terminal section after forming in the connector fabrication process.

To concretely show the shape of each of these members, the body section 9 of one of the pin housings 2 is a molded part shown in the plan view of FIG. 7 and in the front view of FIG. 8. The base section 10 thereof is a molded part shown in the plan view of FIG. 9 and in the partly sectioned side view of FIG. 10. One pin holder 7 is a molded part shown in the plan view of FIG. 11 and in the front view of FIG. 12, while the other pin holder 8 is also a molded part shown in the plan view of FIG. 13 and in the rear view of FIG. 14. As shown in these drawings,a multitude of parallel guide grooves 7*a* into which the terminal sections 12 of a multitude of pin contacts 1 protruding out from the body section 9 at the upper stage can be inserted and positioned are formed in the front and bottom surfaces of the pin holder 7. In the pin holder 8 a multitude of parallel guide grooves 8*a* are formed in the back and bottom surfaces, into which the terminal section 12 of a multitude of pin contacts 1 protruding from the body section 9 at the lower stage can be inserted and positioned. Both of the pin holders 7 and 8 are mounted on the base section 10 with projections 10*a* and 10*b* of the base section 10 inserted into insertion holes 7*b* and 8*b* respectively. Before installation of these pin holders 7 and 8 on the base section 10, as shown in FIG. 15, the end portion 12*a* (soldered portion) of the terminal section 12 of the pin contact 1 is bent upwards by forming in relation to the printed board 19, so that the end portion 12*a* of each terminal section 12 will be held flat in elastic contact with the bottom surface of the pin holder 7 or the pin holder 8. It is therefore possible to dispose the forward end portion 12*a* of each terminal section 12 without tilting in a specific position on the printed board 19 by mounting the pin housing 2 on the printed board 19 so that the bottom surfaces of the pin holders 7 and 8 will be very closely faced by the mounting surface.

In the present embodiment, the pin holders 7 and 8 are mounted in the pin housing 2, for positioning the terminal sections 12 of a multitude of pin contacts 1 in the guide grooves 7*a* and 8*a*, and for holding the end portion 12*a* of each terminal section 12 in elastic contact with the bottom surface. Therefore, not only the terminal sections 12 can be held parallelly but the end portions 12*a* to be soldered on the printed board 19 can also be held level. Thus it is possible to prevent displacement or tilt of the end portion 12*a* of each terminal section 12 by mounting the pin housing 2 on the printed board 19 with the bottom surfaces of the pin holders 7 and 8 closely set oppositely to the mounting surface, thereby allowing easily and reliably soldering each terminal 12 in a specific position on the printed board 19.

Subsequently, the frame 4 of the face-mounted PC card connector of the present invention and the ejection mechanism (the eject lever 5 and the push rod 6) attached on the frame 4 will be explained in detail.

Figure 2:
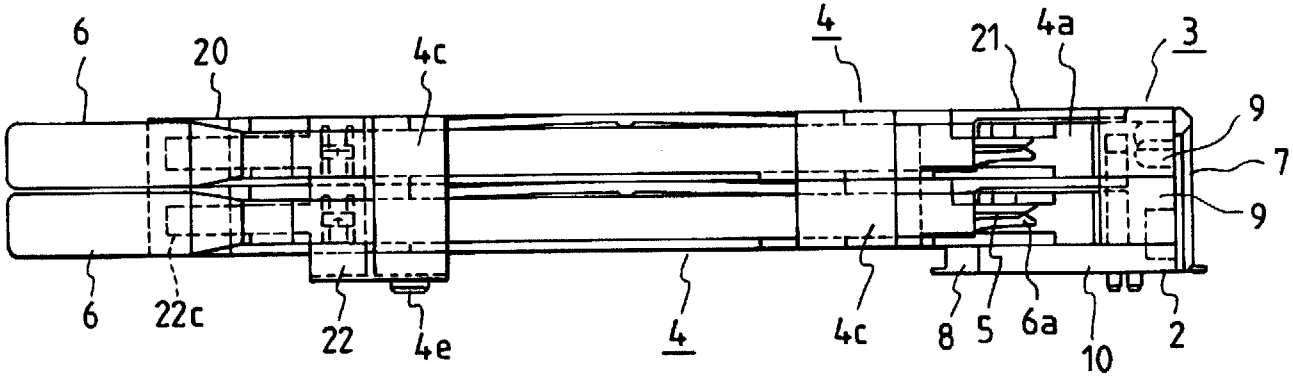
FIG. 2 is a general side view of the connector.
Figure 3:
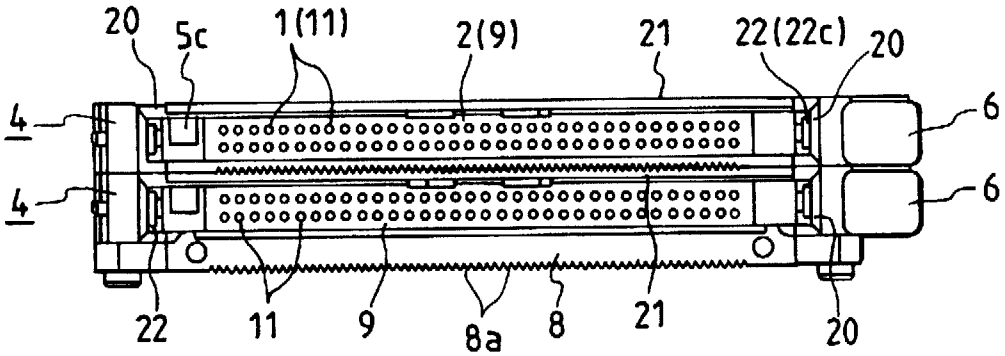
FIG. 3 is a general front view of the connector.
Figure 4:
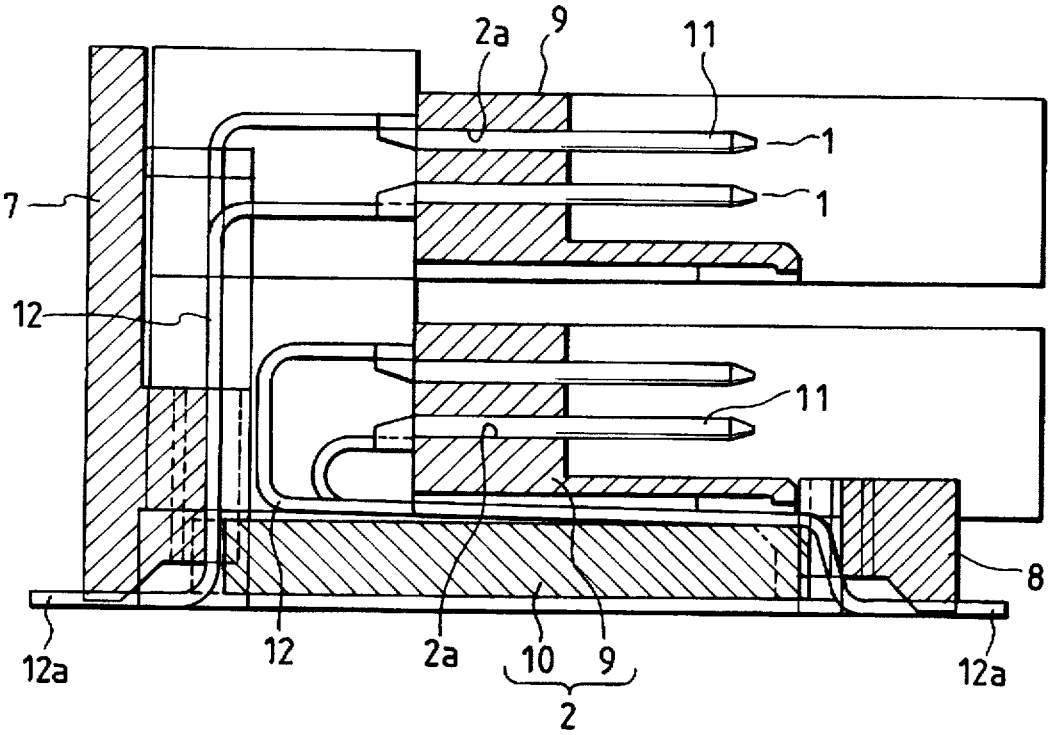
FIG. 4 s a sectional view of a pin header section of the connector.
Figure 16:
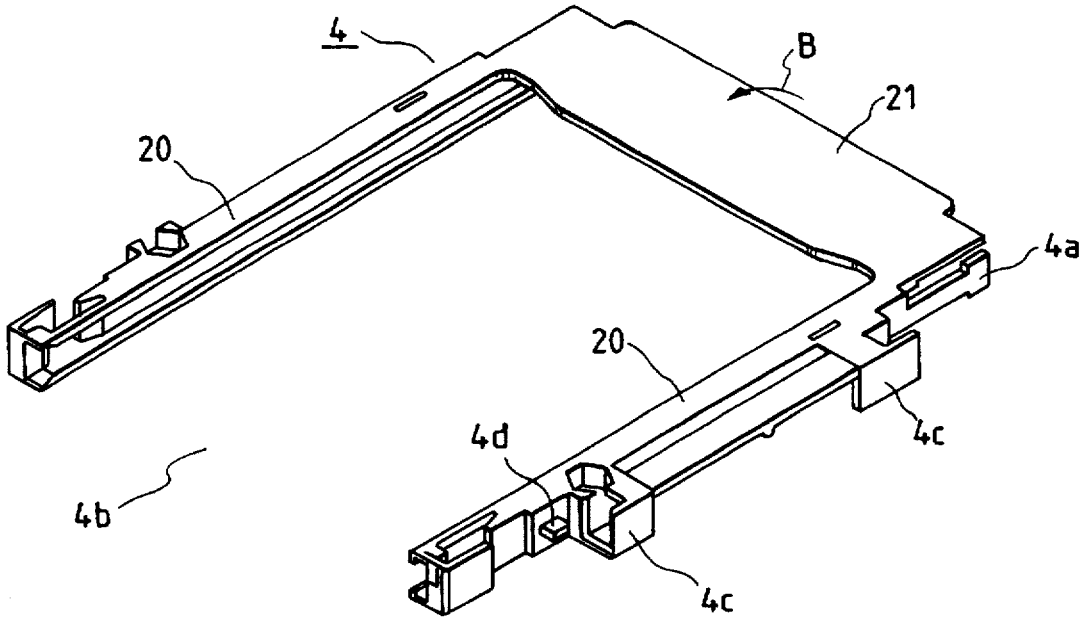
FIG. 16 is a perspective view of a frame of the connector.

The connector uses two approximately U-shaped frames 4 as shown in FIG. 16 which are vertically mounted in two stages; on the upper frame 4, approximately T-shaped locking pieces 4*a* mounted projecting on both the right and left sides of the rear end section thereof are fitted in the side wall of the body section 9 of the upper stage of the pin housing 2, while on the lower frame 4 a similar locking piece 4*a* is fitted in the side wall of the body section 9 at the lower stage of the pin housing 2. Each of the frames 4 is provided with a pair of groove sections 20 extending longitudinally to guide both sides in the direction of width of the PC card when the PC card is inserted, and to define a card slot 4*b* at the front end, and with a bridge section 21 connecting the groove sections 20 at the rear end. When the locking piece 4*a* is fitted in the side wall of the body section 9, the pin contact 1 pressed in and secured in this body section 9 appears in the card slot 4*b*. Each of the frames 4 is formed a little narrow at a portion where the bridge section 21 and the groove sections 20 are connected, to provide the bridge section 21 with flexibility for deflecting towards (in the direction of the arrow B in FIG. 16) a pair of groove sections 20. In the intermediate part of the bridge section 21 of each frame 4, two round bosses 21*a* and 21*b* are projectingly provided and inserted in two shaft holes 5*a* and 5*b* made by drilling in the intermediate part of the eject lever 5 as shown in FIG. 1. The eject lever 5 is rotatably supported on the frame 4 through the round boss 21*a* as a rotating shaft. Furthermore, a rod support frame 4*c* is projectingly provided on the outer side of one groove section 20 of each frame 4, by which the push rod 6 is longitudinally movably supported. Then, the eject lever 5 engages at one end with a bifurcated section 6*a* at the end of the push rod 6 as shown in FIG. 2, and a card contact piece 5*c* at the other end of the eject lever 5 longitudinally moves slightly forward and backward in a corner in the pin header section 3 with the rotation of the lever 5. The eject lever 5 is produced of a metal plate, while the push rod 6 is a resinous molded part.

That is, the connector is of such a construction that when the PC card inserted into the frame 4 through the upper or lower card slot 4*b* goes into the rear pin header section 3, the card contact piece 5*c* of the eject lever 5 is pushed in backward by the PC card. Then, immediately after the push rod 6 moves to the front, the socket contact in the PC card is connected with the pin contact 1, thus completing card insertion. Also, when the PC card is to be pulled out, a corresponding push rod 6 is pushed in to turn the eject lever 5 counterclockwise in FIG. 1, and the card contact piece 5*c* tends to move forward. The PC card is then pushed into the contact piece 5*c*, coming off from the pin contact 1. Thus the PC card can readily be pulled out of the card slot 4*b* by fingers.

Figure 17:
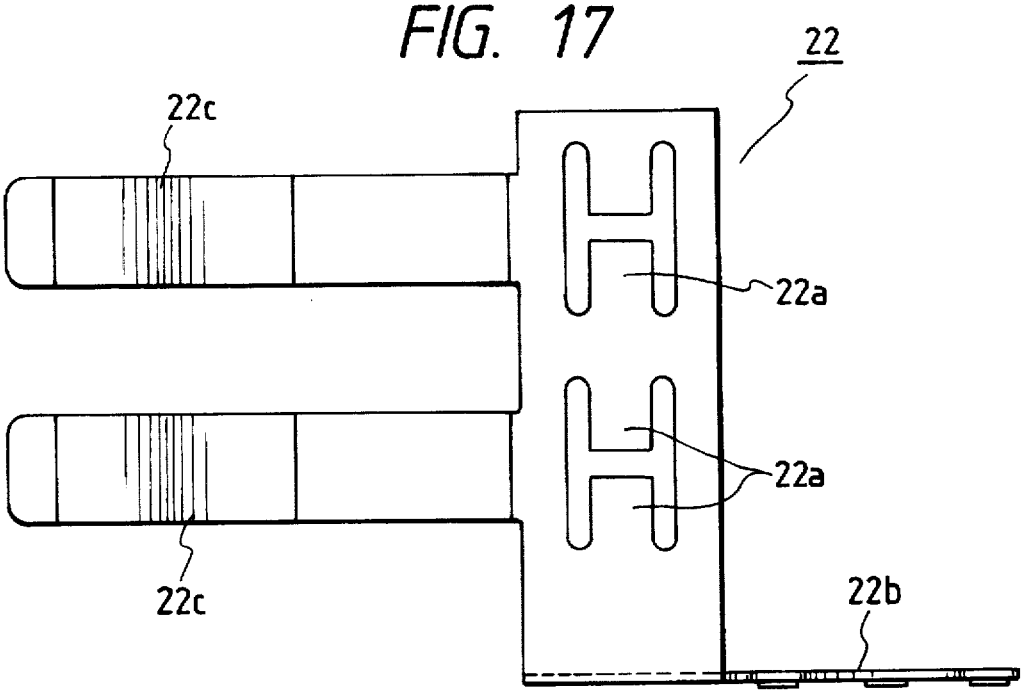
FIG. 17 is a side view of a grounding metal of the connector.
Figure 18:
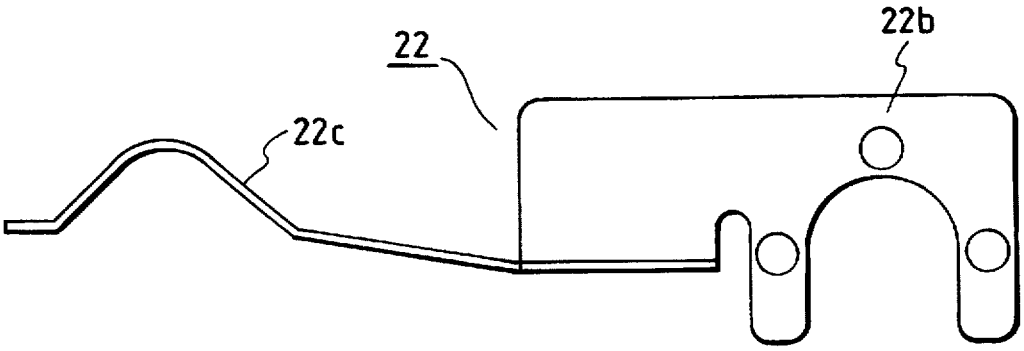
FIG. 18 is a plan view of the grounding metal.
Figure 19:
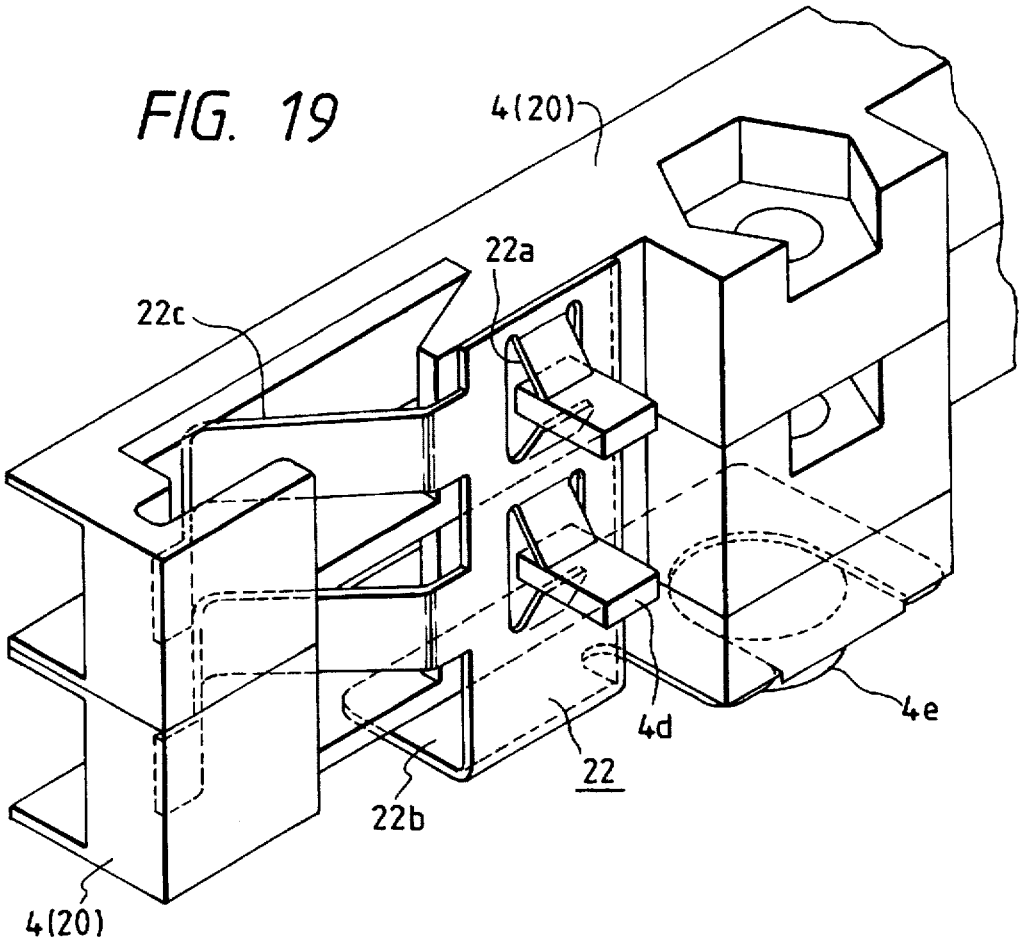
FIG. 19 is a perspective view of a major portion showing the condition of the grounding metal mounted on the frame.
Figure 20:
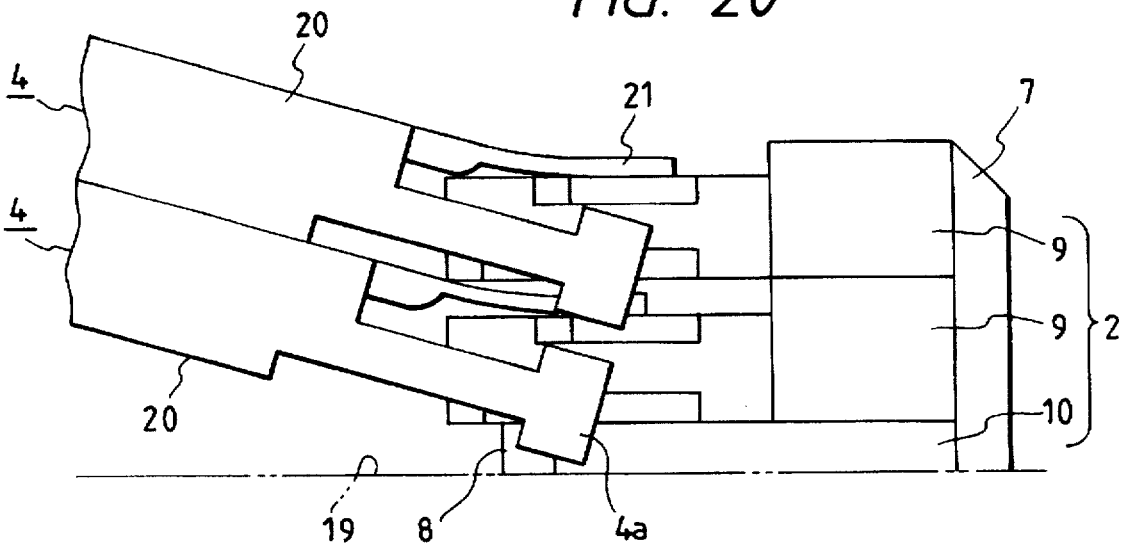
FIG. 20 is an explanatory view showing the condition of the frame to be mounted to the pin header section mounted with the connector.

The connector of the present embodiment has the body section 9 with the pin contacts 1 secured in a specific arrangement at the upper and lower stages, the frame 4 having the card slot 4*b* at the front end and mounted at the rear end to the body section 9, and the eject lever 5 and the push rod 6 both supported on the frame 4, so that two PC cards can be inserted into either of the upper and lower card slots. The upper and lower frames 4 are connected at four points, two at front and two at rear. At the right and left front of these connecting points are used grounding metals 22 which are connecting metals serving also as grounding terminals. The grounding metal 22 has a shape as shown in the side view of FIG. 17 and in the plan view of FIG. 18 before it is mounted on the frame 4. As shown in FIG. 19, however, the grounding metals 22 can smoothly be installed with a snap from outside to the upper and lower frames 4 by pressing in a square boss 4*d* projectingly provided in the groove section 20 of the frame 4 while deflecting a tongue section 22*a* and also by engaging the bottom plate section 22*b* with a positioning boss 4*e* projectingly provided on the bottom section of the frame 4 for the purpose of positioning to the printed board 19. The grounding metal 22 thus installed is arranged in such a position that a pair of curved elastic pieces 22*c* extending towards the front end side will come in elastic contact with the surface of the PC card within the upper and lower frames 4 at the time of insertion, and at the same time the bottom plate section 22*b* will be arranged in pressure contact with the grounding circuit not illustrated of the printed board 19 at the stage of actual mounting.

The frame 4 for a single PC card is arranged in two upper and lower stages to form a connector enabling the use of two PC cards. When a part of a metal for connecting the two frames 4 at a plurality of places is used as the grounding metal 22 which serves as a grounding terminal, it will become unnecessary to form a special frame for the use of the two PC cards and also to install the grounding terminal separately for each frame 4, thereby enabling to substantially decrease a manufacturing cost. Furthermore, using the grounding metal 22 can decrease the number of special members for connection, thereby preventing the number of components and assembling man-hours from increasing. Also easy installation of the grounding metal 22 with a snap to each frame 4 from outside will insure good assembling efficiency.

Furthermore, since the pin housing 2 and the frame 4 are separated, the connector allows the mounting of the frame 4 on the pin housing 2 after automatically mounting the pin header section 3 on the printed board 19. In the present embodiment, as previously stated, the bridge section 21 of each frame 4 is provided with flexibility for deflecting towards a pair of groove sections 20. Therefore when the frame 4 is installed to the pin header section 3 after mounting, the locking piece 4*a* at the rear end of this frame 4 can easily be fitted in the side wall of the pin housing 2 by pushing in the frame 4 towards the pin header section 3 while deflecting the bridge section 21 diagonally from above to the mounting surface of the printed board 19. Accordingly if any other part has been mounted beneath the frame 4, the frame and the existing pin header section 3 can be assembled to one unit without giving a damage to them, thus accomplishing high-density mounting. Furthermore, because the frame 4 is mounted to the pin header section 3 that has been mounted, the material of the frame 4 to be used is not necessarily required to have great heat resistance and may be produced of a comparatively cheap resin such as PBT.

In the above-described embodiment the PC card connector has been explained. It should be noticed that the present invention is applicable to other connectors fitted with similar pin contacts.

Figure 21:
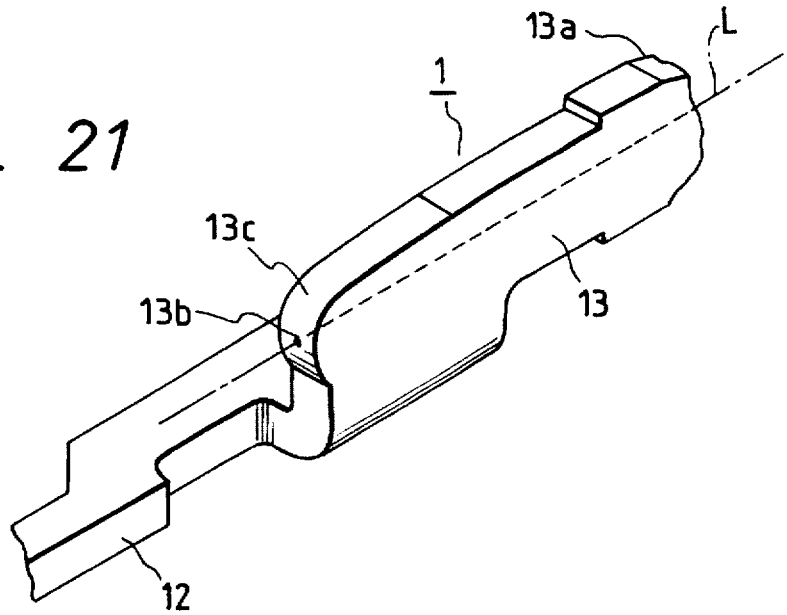
FIG. 21 is a perspective view showing a major portion of a pin contact of another embodiment of the present invention.
Figure 23:
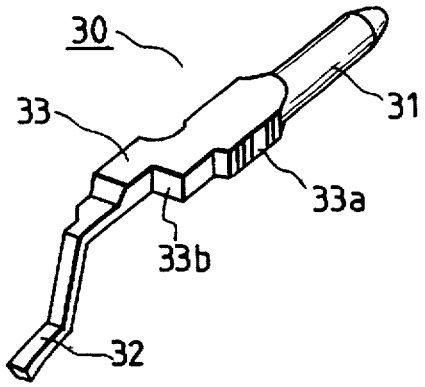
FIG. 23 PRIOR ART
FIG. 23 is a perspective view of a major portion of a pin contact in conventional use.
Figure 24:
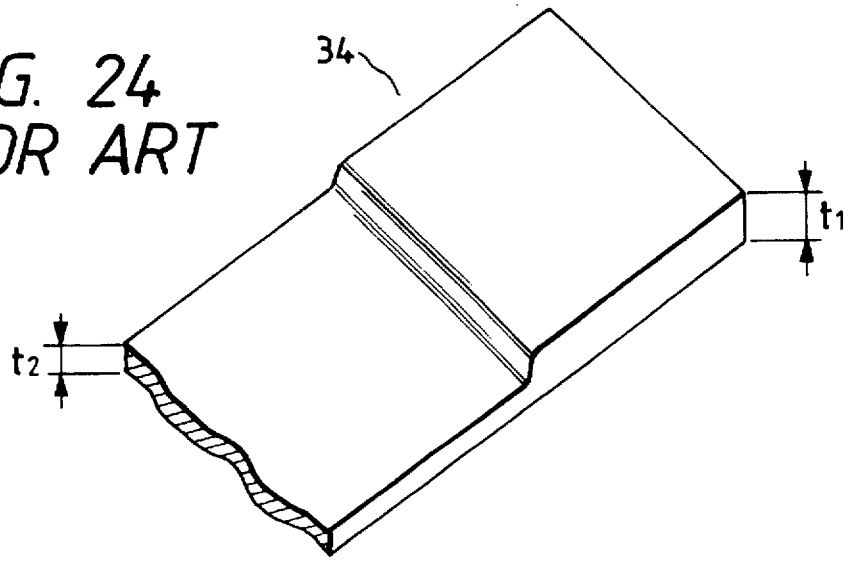
FIG. 24 PRIOR ART
FIG. 24 is a perspective view of a sheet of irregular shape in conventional use for fabricating the pin contact shown in FIG. 23.
Figure 22B:
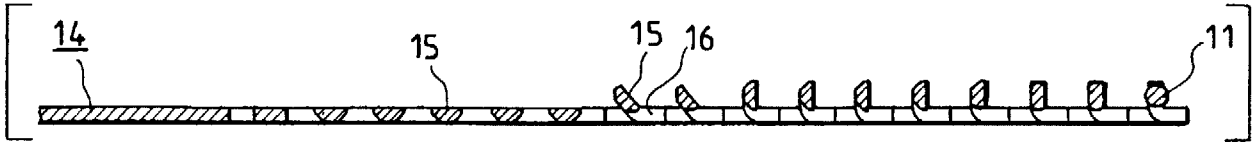
FIGS. 22A and 22B show top and section side views of a fabrication process chart of the pin contact shown in FIG. 21.
Figure 22A:
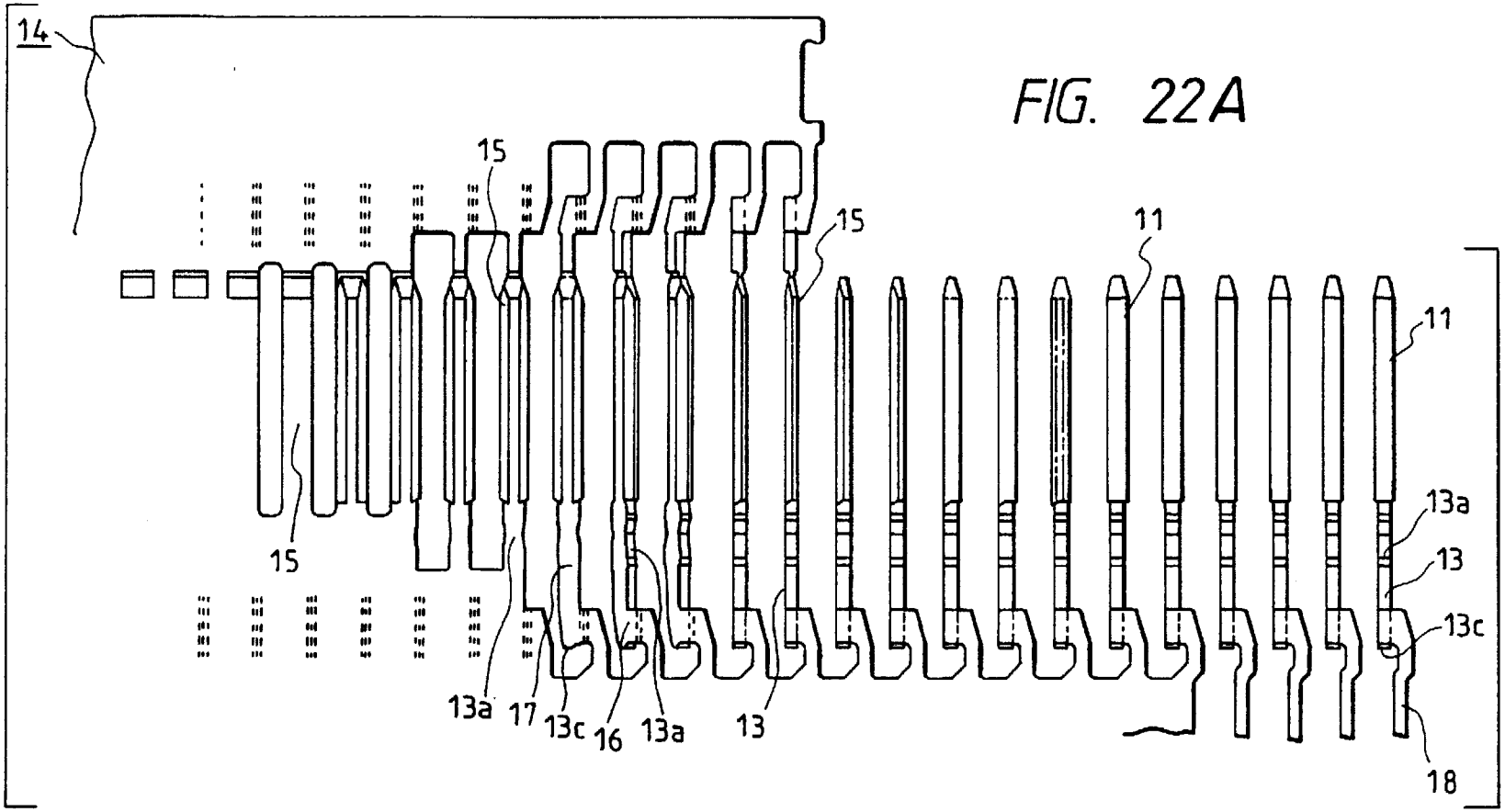

Next, another embodiment of the present invention will be explained with reference to FIGS. 21, 22A and 22B. FIG. 21 is a perspective view showing a major portion of the pin contact of the present embodiment; and FIGS. 22A and 22B show top and section side views of a fabricating process chart of the pin contacts. In these drawings members corresponding to those in FIGS. 5, 6A and 6B used in explaining the above-described embodiment are designated by the same reference numerals.

The pin contact 1 shown in FIG. 21, as is clear from comparison with FIG. 5, differs largely from the above-described embodiment in the shape of the rear end section of the raised piece 13 raised squarely in relation to the base of the terminal section 12. That is, a convexly curved surface 13*c* is formed on the rear end of the raised piece 13 of the pin contact 1, and the top section of this convexly curved surface 13*c* is set in a position in which it intersects the extension L of the axial center of the contact section, so that, in the present embodiment, the top section will function as the jig receiving section 13*b*.

When the pin contact 1 thus shaped is inserted into the pin insertion hole of the pin housing not illustrated, the mounting jig reliably abuts with the top section of the convexly curved surface 13*c*. The top section is formed in a position in which it intersects the extension L of the axial center of the contact section. The contact section of the pin contact 1 is pushed by the jig from right behind and the pressure to push in the jig will never go off the axial center of the contact section. Consequently, it is possible to avoid occurrence of such an unexpected trouble as the application to the pin contact 1 of so great a pressure as to deform the base, for example, of the terminal section 12 at the time of insertion, thereby improving reliability and feasibility of assembling of the products.

The pin contact 1 the major portion of which is shown in FIG. 21 is fabricated according to the process which proceeds from left to right in FIG. 22A. It is, therefore, sufficient to form the convexly curved surface 13*c* on the rear end surface of the narrow piece 17 prior to raising in FIG. 22. FIGS. 22A, 22B, 6A and 6B respectively show, changes in the planar and sectional forms of a flat metal sheet under fabrication into pin contacts. Details of the fabrication process of the present embodiment are basically the same as the above-described embodiment and therefore will not be explained.

What is claimed is:

1. A pin contact for a connector, the pin contact comprising:

a contact section including:

an elongated raised portion having a first end and a second end, the second end including a rear edge forming a jig receiving surface, the elongated raised portion also including a first side edge and a second side edge, and a locking section formed on the first side edge, and a cylindrical portion connected to the first end of the raised portion; and a terminal section having a base connected to the second side edge adjacent the second end of the raised portion, the base extending at an approximately right angle from the raised portion;

wherein the raised portion and the terminal section are formed by bending a plate such that the raised portion and the terminal section have a uniform thickness.

2. The pin contact of claim 1, wherein the contact section defines a longitudinal axis extending through the rear edge of the raised portion, and wherein the jig receiving section is a convex surface extending from the rear edge and includes an apex which intersects the longitudinal axis.

* * * * *